US008978182B2

(12) United States Patent
Receveur

(10) Patent No.: US 8,978,182 B2
(45) Date of Patent: Mar. 17, 2015

(54) OCCUPANT PROTECTIVE FEATURES FOR THE FOOT REGION OF A BED

(75) Inventor: Timothy Joseph Receveur, Guilford, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 728 days.

(21) Appl. No.: 12/877,597

(22) Filed: Sep. 8, 2010

(65) Prior Publication Data

US 2012/0054960 A1 Mar. 8, 2012

(51) Int. Cl.

| | |
|---|---|
| ***A47C 20/04*** | (2006.01) |
| ***A47B 7/02*** | (2006.01) |
| ***A47B 7/00*** | (2006.01) |
| ***A47C 20/02*** | (2006.01) |
| ***A47C 31/00*** | (2006.01) |
| ***A47C 17/86*** | (2006.01) |
| ***A61G 7/05*** | (2006.01) |
| ***A61G 7/057*** | (2006.01) |
| ***A61G 7/075*** | (2006.01) |
| *A61G 7/012* | (2006.01) |
| *A61G 7/015* | (2006.01) |

(52) U.S. Cl.

CPC ..... *A61G 7/0506* (2013.01); *A61G 7/05769* (2013.01); *A61G 7/0755* (2013.01); *A61G 7/012* (2013.01); *A61G 7/015* (2013.01); *A61G 7/05715* (2013.01); *A61G 7/05738* (2013.01)

USPC ..... 5/651; 5/615; 5/624; 5/648; 5/661

(58) Field of Classification Search

USPC ..... 5/615, 53.1, 618, 624, 648, 651, 183, 5/661

See application file for complete search history.

(56) References Cited

U.S. PATENT DOCUMENTS

| | | | | |
|---|---|---|---|---|
| 3,343,184 | A * | 9/1967 | Friedman et al. | 5/651 |
| 3,523,310 | A | 8/1970 | Shead | |
| 3,571,828 | A * | 3/1971 | Bergsgaard et al. | 5/651 |
| D221,726 | S * | 9/1971 | Johnson | D6/503 |
| 3,638,250 | A * | 2/1972 | Johnson | 5/651 |
| 3,803,645 | A | 4/1974 | Oliverius | |
| 3,866,251 | A | 2/1975 | Pounds | |
| 4,181,992 | A | 1/1980 | Blake | |
| 4,941,221 | A | 7/1990 | Kanzler | |
| 5,175,899 | A | 1/1993 | Lou | |
| 5,673,447 | A | 10/1997 | White | |
| 5,745,939 | A | 5/1998 | Flick et al. | |

(Continued)

FOREIGN PATENT DOCUMENTS

EP 1281380 A2 2/2003

OTHER PUBLICATIONS

European Search Report; Application No. EP11180074; Place of Search—The Hague; Date of Completion of the Search—Mar. 7, 2013.

*Primary Examiner* — Nicholas Polito
*Assistant Examiner* — Eric Kurilla
(74) *Attorney, Agent, or Firm* — Barnes & Thornburg LLP

(57) ABSTRACT

A bed frame includes a weight bearing framework 30, and a footboard 82 that cooperates with the framework to define an edge 90 of an occupant region 92 of the bed. The footboard 82 includes a footboard frame 100 and a pressurizable cushion 104. A mattress system 160 includes a main occupant support portion 162 with a support surface 168 and a cushion 170 located footwardly of the occupant support portion. The cushion has a deployed state in which it projects vertically higher than the support surface and a stored state in which it does not project vertically higher than the support surface.

19 Claims, 17 Drawing Sheets

(56) References Cited

U.S. PATENT DOCUMENTS

| | | | | |
|---|---|---|---|---|
| 5,966,762 | A | 10/1999 | Wu | |
| 5,978,991 | A * | 11/1999 | Miles | 5/651 |
| 6,212,714 | B1 | 4/2001 | Allen | |
| 6,880,189 | B2 | 4/2005 | Welling | |
| 7,555,795 | B1 | 7/2009 | Feil | |
| 2001/0001163 | A1 | 5/2001 | Allen et al. | |
| 2001/0016960 | A1 * | 8/2001 | Grabell et al. | 5/648 |
| 2006/0016012 | A1 * | 1/2006 | Liu | 5/651 |
| 2007/0169271 | A1 * | 7/2007 | Allen et al. | 5/624 |
| 2010/0101025 | A1 | 4/2010 | Corallo | |

* cited by examiner

OCCUPANT PROTECTIVE FEATURES FOR THE FOOT REGION OF A BED

TECHNICAL FIELD

The subject matter described, herein relates to features for protecting the occupant of a bed from undesirable conditions or events such as migration toward the foot end of the bed, foot drop, and excessive interface pressure exerted on the occupant's feet. The preventive features described herein are especially applicable to beds used in hospitals, other health care facilities and home health care settings.

BACKGROUND

Beds of the type used in health care settings include a frame, a deck, and a mattress resting on the deck. The deck is typically comprised of two or more deck sections. At least some of the deck sections are orientation adjustable so that the occupant or a caregiver can change the overall profile of the deck and mattress. Such beds also include a footboard extending laterally across the foot end of the bed and extending vertically to an elevation higher than the elevation of the top of the mattress. Some beds include provisions to alter the longitudinal position of the footboard to accommodate mattresses of differing lengths and occupants of different heights.

Forces exerted on the bed occupant during profile adjustment of the bed can push the occupant longitudinally toward the foot of the bed, subjecting the occupant's skin to undesirable shear stress and compromising the operation of any bed features that are sensitive to the occupant's longitudinal position. It is, therefore, desirable to design the bed with features that prevent or minimize such longitudinal migration or that allow for easy and convenient mitigation of sheer stress and suboptimal occupant position that has occurred.

Under some circumstances the occupant's feet may contact the footboard. Although this can result from occupant migration which is not mitigated as described above, it can also be intentional. For example the occupant and/or footboard may be intentionally positioned so that the occupant's feet rest against the footboard. This may help prevent foot drop, however the interface pressure between the occupant's feet and the footboard, if sustained for a long time, increases the risk of pressure ulcers developing on the occupant's feet.

Accordingly, it is desirable to provide a bed with features that help prevent occupant migration, are useful for repositioning the occupant if migration does occur, and that reduce the likelihood that pressure ulcers will develop on the occupant's feet if they are in intentional or unintentional contact with the footboard for an extended time.

SUMMARY

The present application describes a bed frame comprising a weight bearing framework, and a footboard that cooperates with the framework to define an edge of an occupant region of the bed. The footboard includes a footboard frame and a pressurizable cushion. The application also describes a mattress system comprising an occupant support portion with a support surface and a cushion located footwardly of the occupant support portion. The cushion has a deployed state in which it projects vertically higher than the support surface and a stored state in which it does not project vertically higher than the support surface.

BRIEF DESCRIPTION OF THE DRAWINGS

The foregoing and other features of the various embodiments of the bed frame and mattress system described herein will become more apparent from the following detailed description and the accompanying drawings in which.

DETAILED DESCRIPTION

Figure 1:
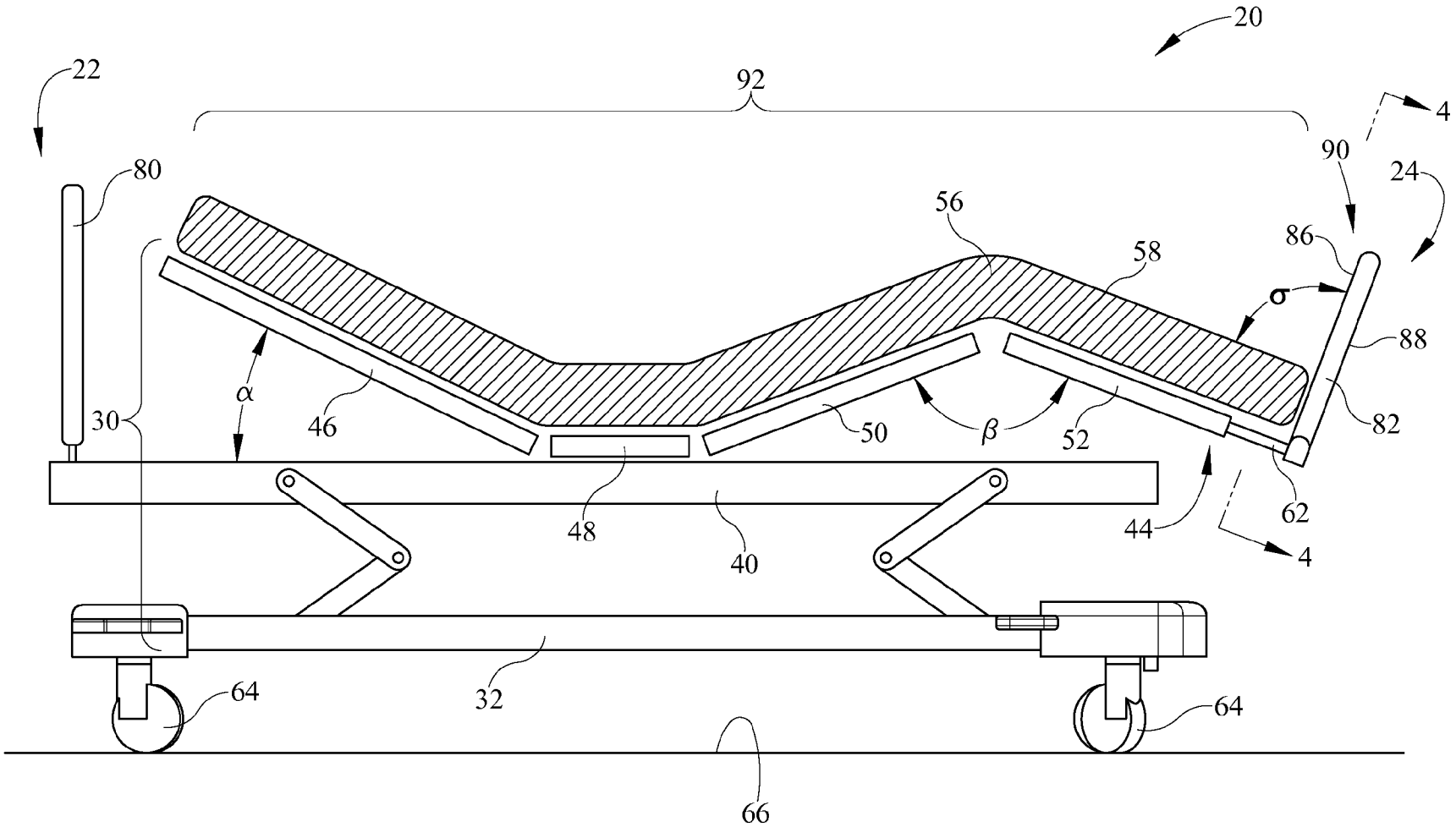
FIG. 1 is a schematic, side elevation view of a hospital bed having a footboard mounted on an extendable and retractable extension of a deck.
Figure 3:
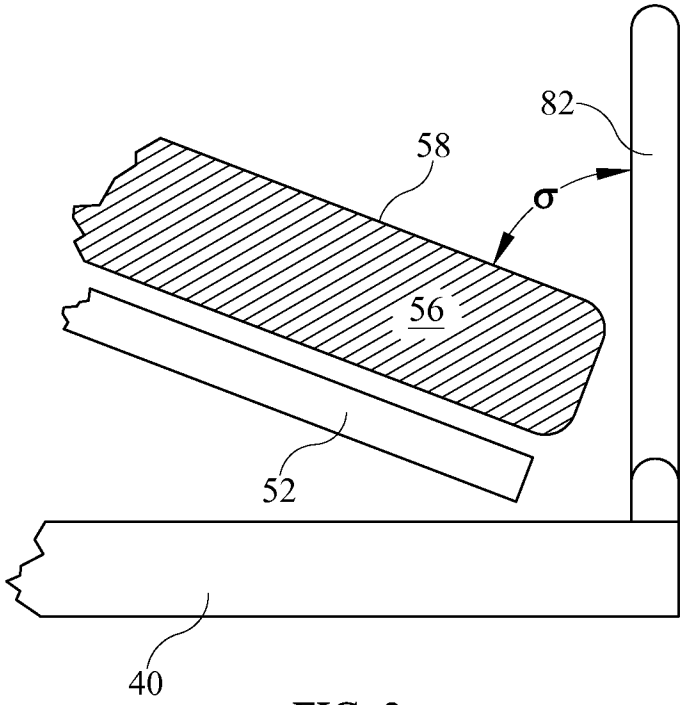
FIG. 3 is a view similar to that of FIG. 1 showing only portion of a bed having a footboard mounted on an elevatable frame.
Figure 2:
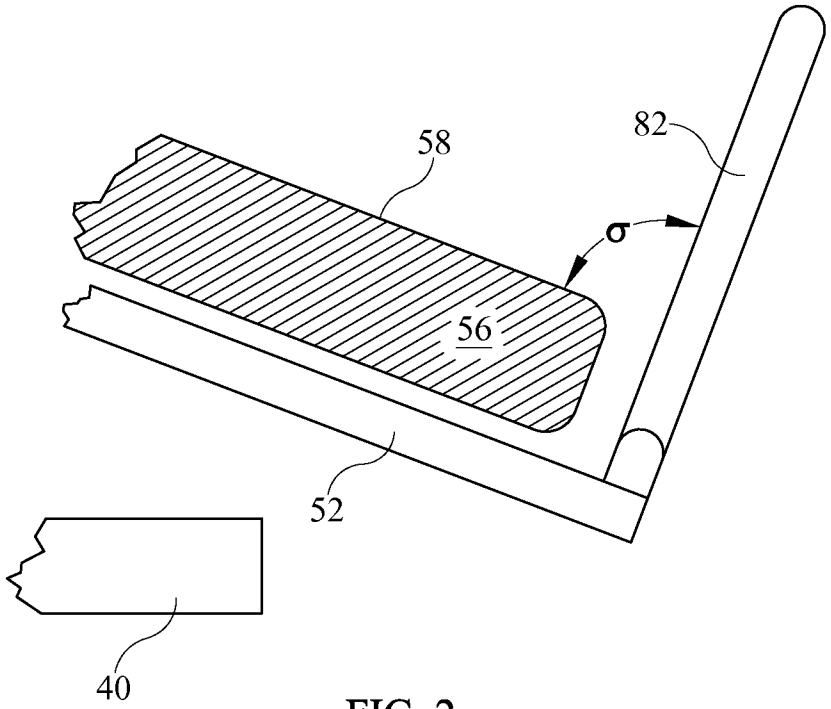
FIG. 2 is a view similar to that of FIG. 1 showing only a portion of a bed having a footboard mounted on a nonextendable deck section.
Figure 4:
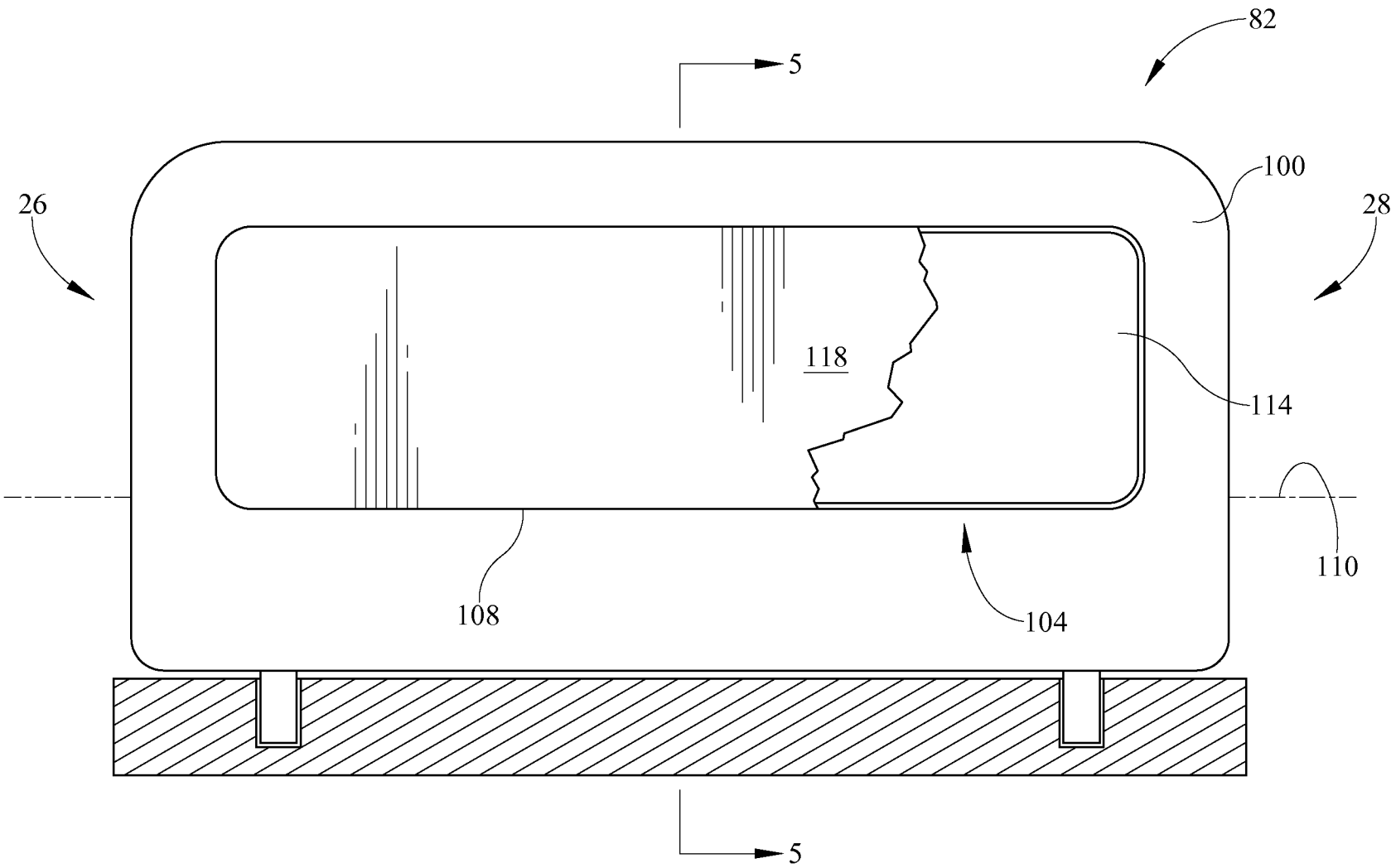
FIG. 4 is a view in the direction 4-4 of FIG. 1.

FIGS. 1-3 shows a hospital bed 20 having a head end 22, a foot end 24 longitudinally spaced from the head end, a left side 26 and a right side 28 (visible in FIGS. 1-3) laterally spaced from the left side. The bed includes a bed frame which includes a weight bearing framework 30 comprising a base frame 32 an elevatable frame 40 supported on the base frame and a deck 44 supported on the elevatable frame. The illustrated deck is a segmented deck comprising a torso or upper body section 46, a seat section 48, a thigh section 50 and a calf section 52. The bed also includes a mattress 56 resting on the deck. The mattress has a top surface 58. The deck of FIG. 1 also includes a calf deck section extension 62, which can be extended or retracted to accommodate mattresses of differing lengths and occupants of different heights. The angular orientation (angles $\alpha$ and $\beta$) of the upper body, thigh and calf sections can be adjusted to achieve a variety of desired bed profiles. Casters 64 extend from the base frame to the floor 66.

The bed frame also includes a headboard 80 mounted on the elevatable frame and a footboard mounted on calf deck section extension 62 (FIG. 1). The footboard has an occupant side 86 and a caregiver side 88. Alternatively, as seen in FIGS. 2 and 3, the deck extension may be absent and the footboard may be mounted on the calf deck section 52 (FIG. 2) or on the elevatable frame 40 (FIG. 3). Irrespective of whether or not extension 62 is present or absent, and irrespective of whether the footboard is mounted on a deck section 52, 62 or on the elevatable frame 40, the footboard cooperates with the framework to define a foot edge 90 of an occupant region 92 of the bed.

Referring to FIGS. 4-7 footboard 82 comprises a comparatively rigid footboard frame 100 bordering a cavity 102 and a comparatively soft, pressurizable cushion 104 having a surface 106 facing toward the occupant region 92 of the bed. The lower extremity or bottom surface 108 of the cushion is substantially at the same elevation 110 as the top of the mattress. In a principal embodiment the cushion is a fluid bladder 114 comprising a fluid impermeable liner 112 containing only a pressurizing fluid (typically air). The bladder includes pleats or folds 116 which give the bladder a bellows-like character. A removeable elastic cover 118 is secured to the bellows, e.g. by a zipper. The cover can be removed for cleaning and disinfecting.

A source of pressurized air such as a compressor 124 is connected to the bladder by a fluid transport line 126. The compressor may be a component of the bed or may be independent of the bed. An aspirator 128, such as a pump 130, is also connected to the bladder. The pump may be a separately identifiable component, as shown, or the pump and compressor may be integrated into a single unit. Optionally, an exhaust valve 132 may be used as an aspirator. Although the illustration shows both pump 130 and an exhaust valve 132 it is expected that a commercial embodiment will require only one or the other.

The bladder has a distended or extended state (FIGS. 5, 7) in which it extends toward the head end of the framework by an amount $d_1$ relative to a reference datum, such as plane 140. The extended state is the result of pressurized air from the air source 124 having been admitted to the interior of the bladder, causing a portion 136 of the bladder to project a distance $d_3$ headwardly beyond the occupant side 86 of the headboard frame. The bladder also has a nonextended state (FIG. 6) in which the bladder extends toward the head end of the framework by an amount $d_2$ relative to the datum, where $d_2$ is less than $d_1$. In the illustrated embodiment the bladder resides entirely inside footboard cavity 102 when in its nonextended state. The nonextended state is the result of pressurized air having been vented from the bladder through exhaust valve 132 or having been removed by the pump 130. It should be appreciated that the intrabladder pressure may need to be elevated to a minimum working pressure before the bladder is effective for its intended purpose.

The footboard may also include provisions for assisting transition from the extended state to the nonextended state. For example if the vent valve 132 is used to relieve intrabladder pressure, a spring 142 can be used to exert a return force on the bladder to accelerate transition from the extended state to the nonextended state subsequent to opening of the exhaust valve, and to ensure that the projecting portion 136 of the bladder is retracted into the cavity 102. The spring can also be used in conjunction with pump 130.

The bladder is constructed so that when it is pressurized to a working pressure, the surface 106 facing the occupant presents a foot receptacle 150 shaped and sized to receive an occupant's foot and to maintain interface pressure between the occupant's feet and the surface at levels low enough to discourage the development of pressure ulcers or the onset of other types of skin breakdown.

In operation, the bed occupant or a caregiver operates the compressor to pressurize the bladder, causing it to increase in volume until it contacts or nearly contacts the occupant's feet. As a result the cushion can help resist any tendency for the occupant to migrate toward the foot end of the bed, as typically occurs in response to an increase in the orientation angle $\alpha$ of the deck upper body section 46. Pressurization of the cushion can be a preparatory step carried out prior to changing the orientation angle $\alpha$ or can be carried out concurrently and in coordination with the change in $\alpha$. In the event that occupant migration does occur, the occupant can push against the bladder with his feet to help reposition himself toward the head end of the bed, thereby at least partially reversing any tissue shear that resulted from the initial footward migration and placing himself in a more favorable position for correct functioning of bed features that are sensitive to occupant position. The soft character of the cushion, augmented by the foot receptacle 150, if provided, also helps reduce the risk of pressure ulcers if the occupant's feet are in intentional or unintentional contact with the footboard for an extended time.

Figure 8:
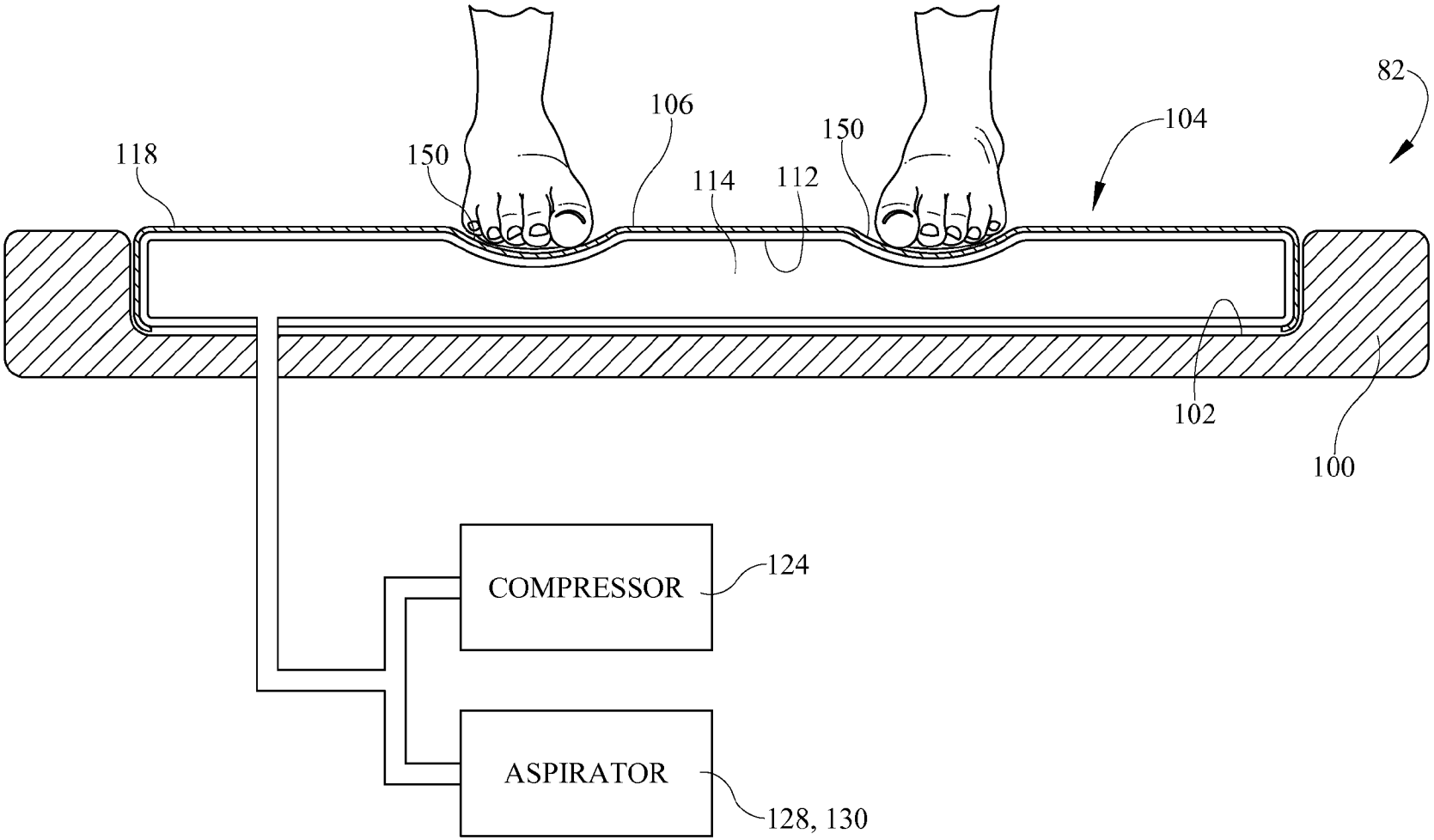
FIG. 8 is a top view of an alternate form of the pressurizable cushion.

FIG. 8 shows an alternate cushion 104, also in the form of a bladder 114. The alternate bladder, unlike the bellows bladder of FIGS. 4-7, does not undergo a significant volumetric change in response to changes in intrabladder pressure. Instead, the illustrated bladder becomes increasingly stiff or firm in response to increasing intrabladder pressure and becomes increasingly soft in response to decreasing intrabladder pressure. A removeable cover 118 is secured to the bellows, e.g. by a zipper. The cover can be removed for cleaning and disinfecting.

Figure 9:
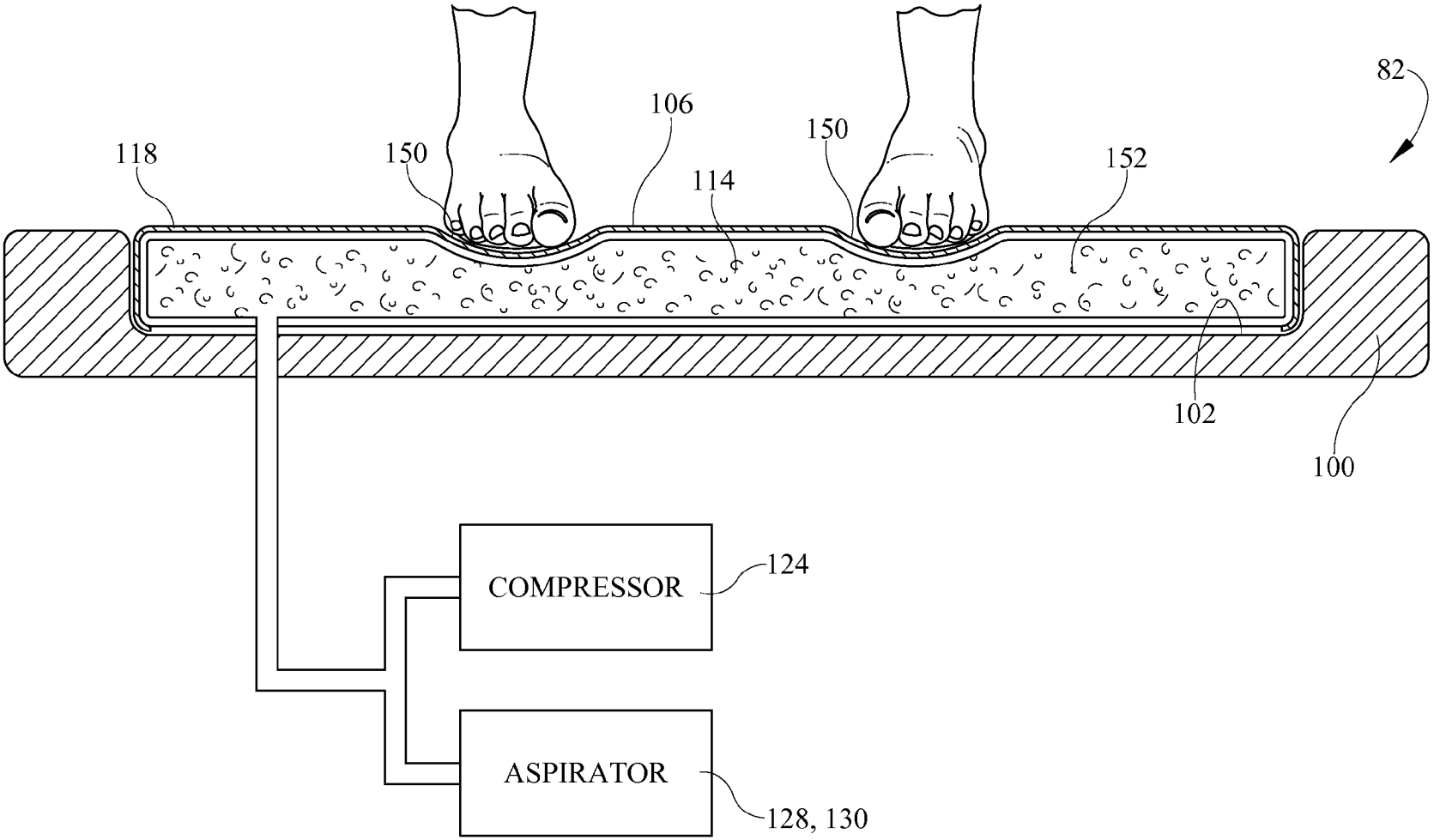
FIG. 9 is a top view of another alternate form of the pressurizable cushion incorporating a foam material.

In the above described embodiments the cushion 104 is a fluid bladder containing only a pressurizing fluid. However other forms of the cushion may include other intrabladder features. FIG. 9 shows one possible alternative in which the cushion comprises a porous foam material 152 inside a fluid-impermeable liner 112. Even when unpressurized or pressurized to a low pressure the cushion presents a soft surface 106 to the bed occupant. With increasing pressurization additional air enters the pores of the foam and any space between the foam and the bladder liner 112 causing the cushion to become stiffer and/or expand in volume depending on the particulars of its construction.

Figure 5:
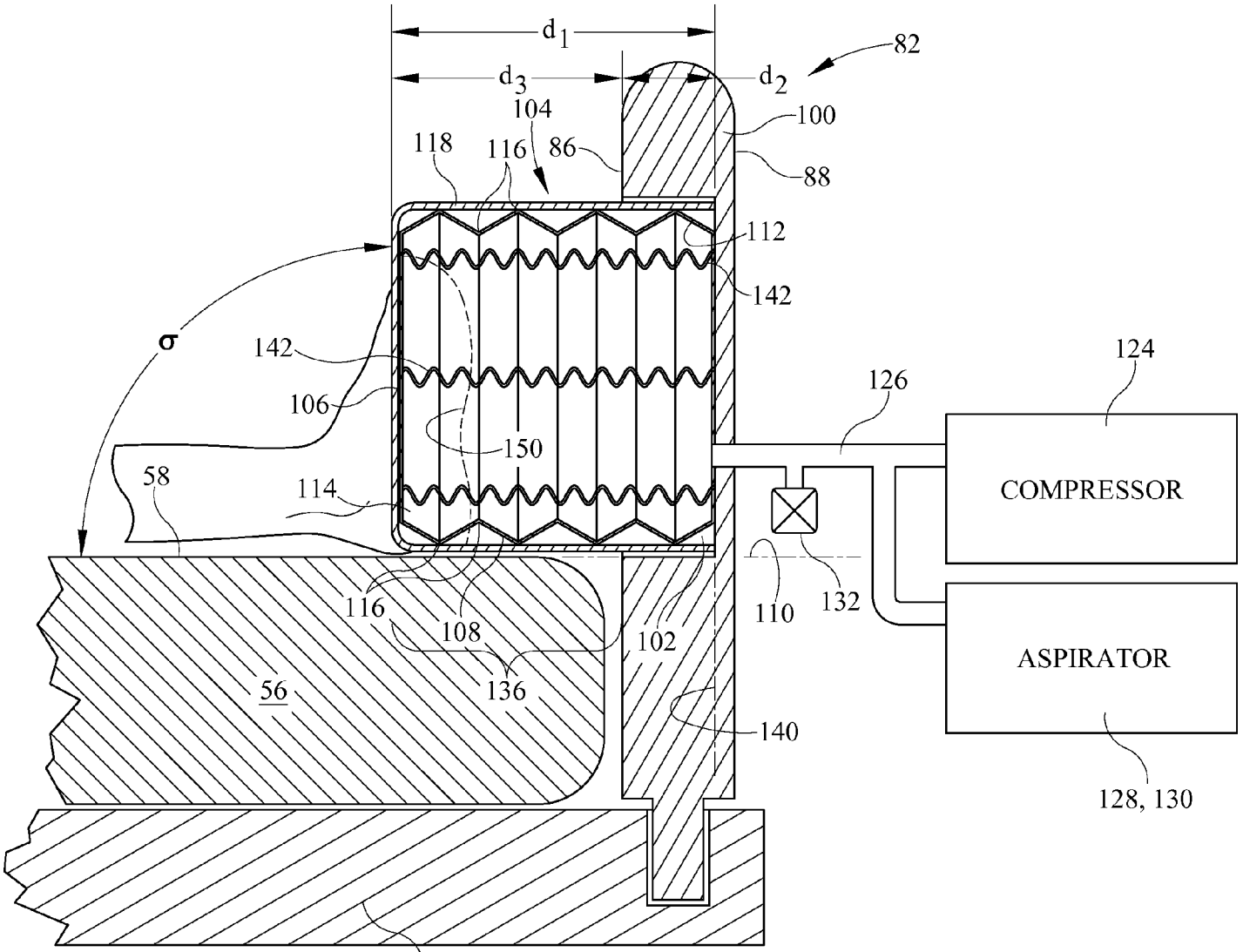
FIG. 5 is a schematic, side elevation view in the direction 5-5 of FIG. 4 depicting additional details including a pressurizable cushion in the form of a bladder, the bladder being shown in an extended or distended state in which it projects a distance $d_3$ beyond an occupant side of a footboard frame.
Figure 6:
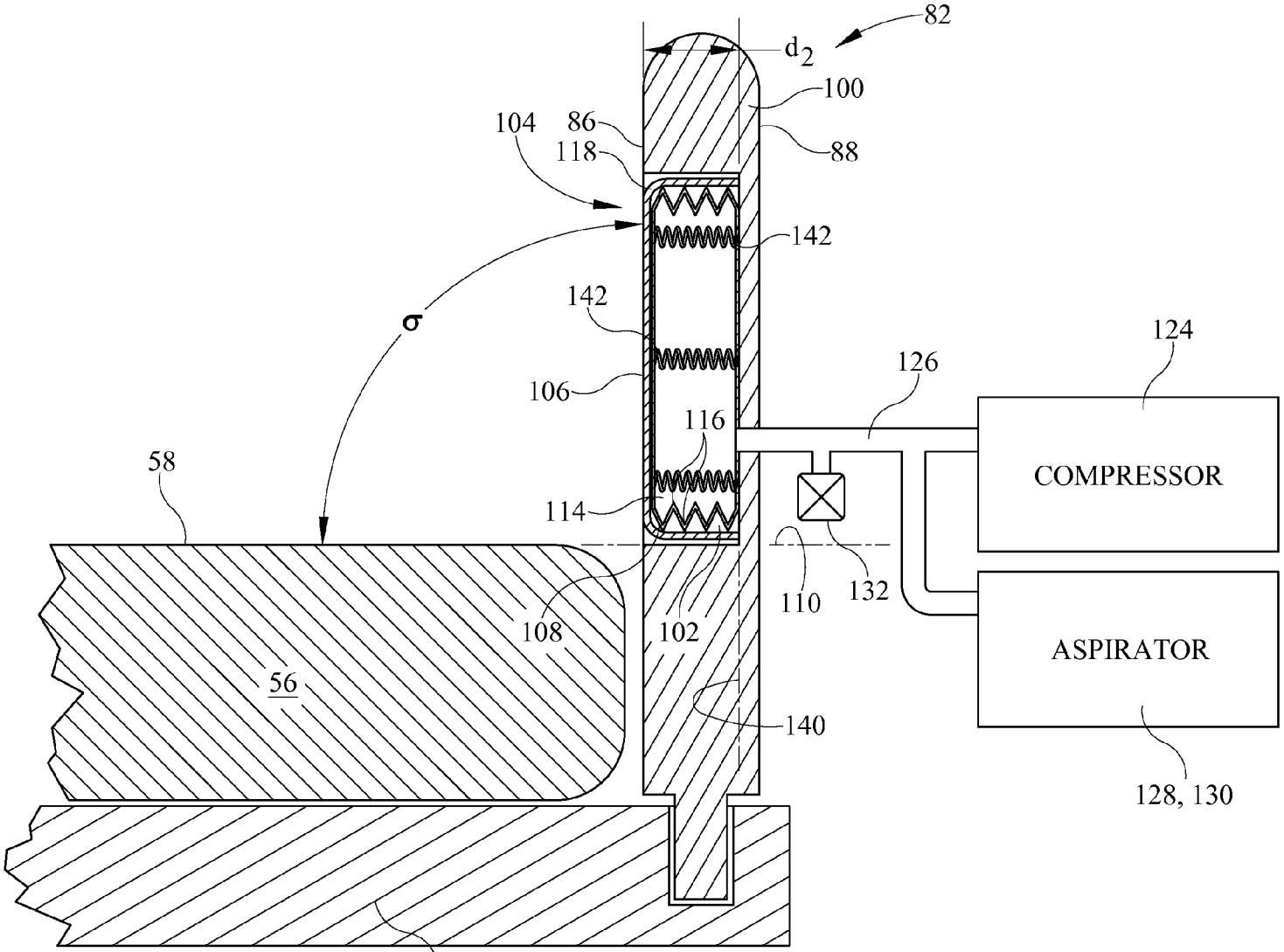
FIG. 6 is a view similar to that of FIG. 5 with the bladder shown in a nonextended state.
Figure 7:
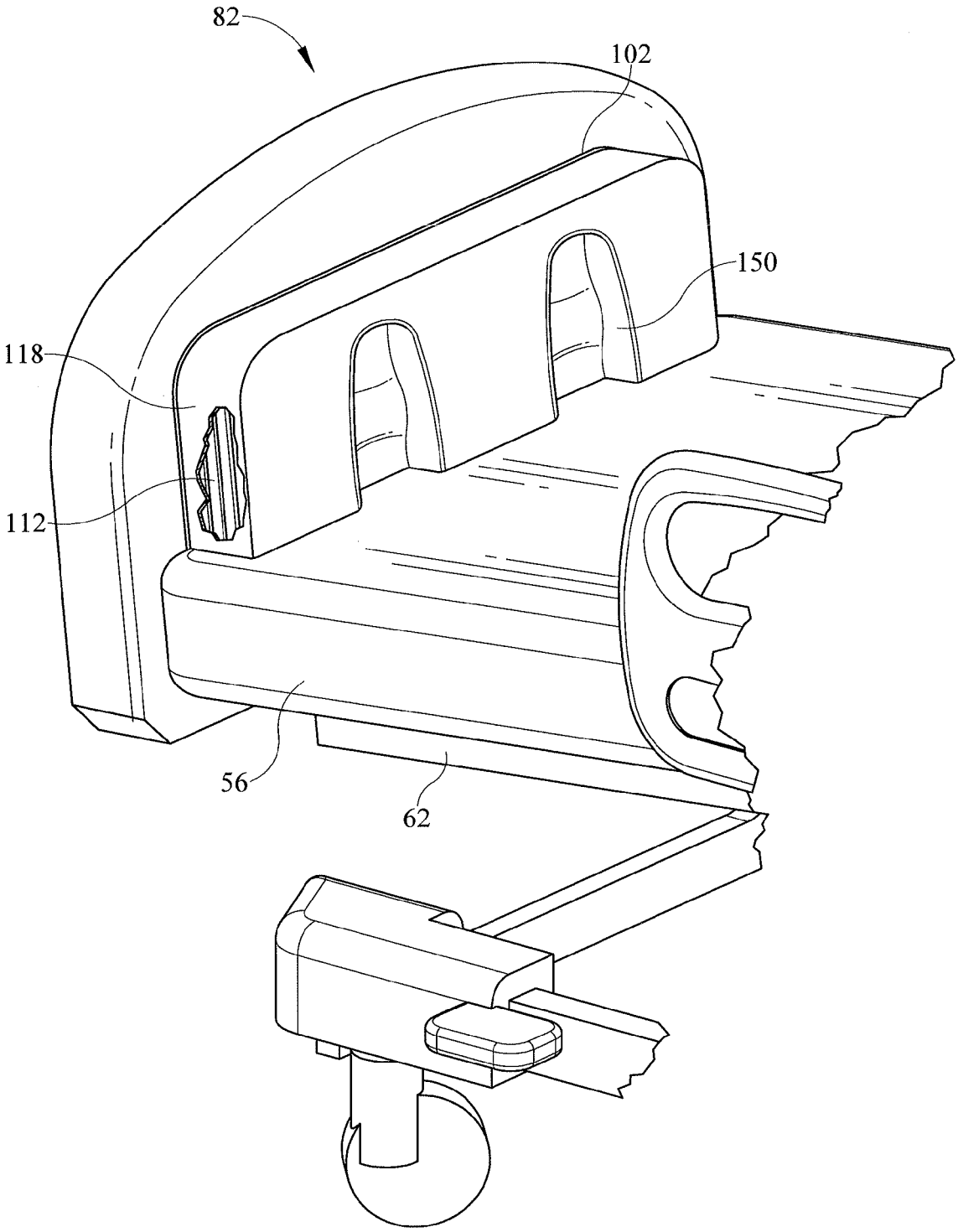
FIG. 7 is a perspective view corresponding to FIG. 5.
Figure 10:
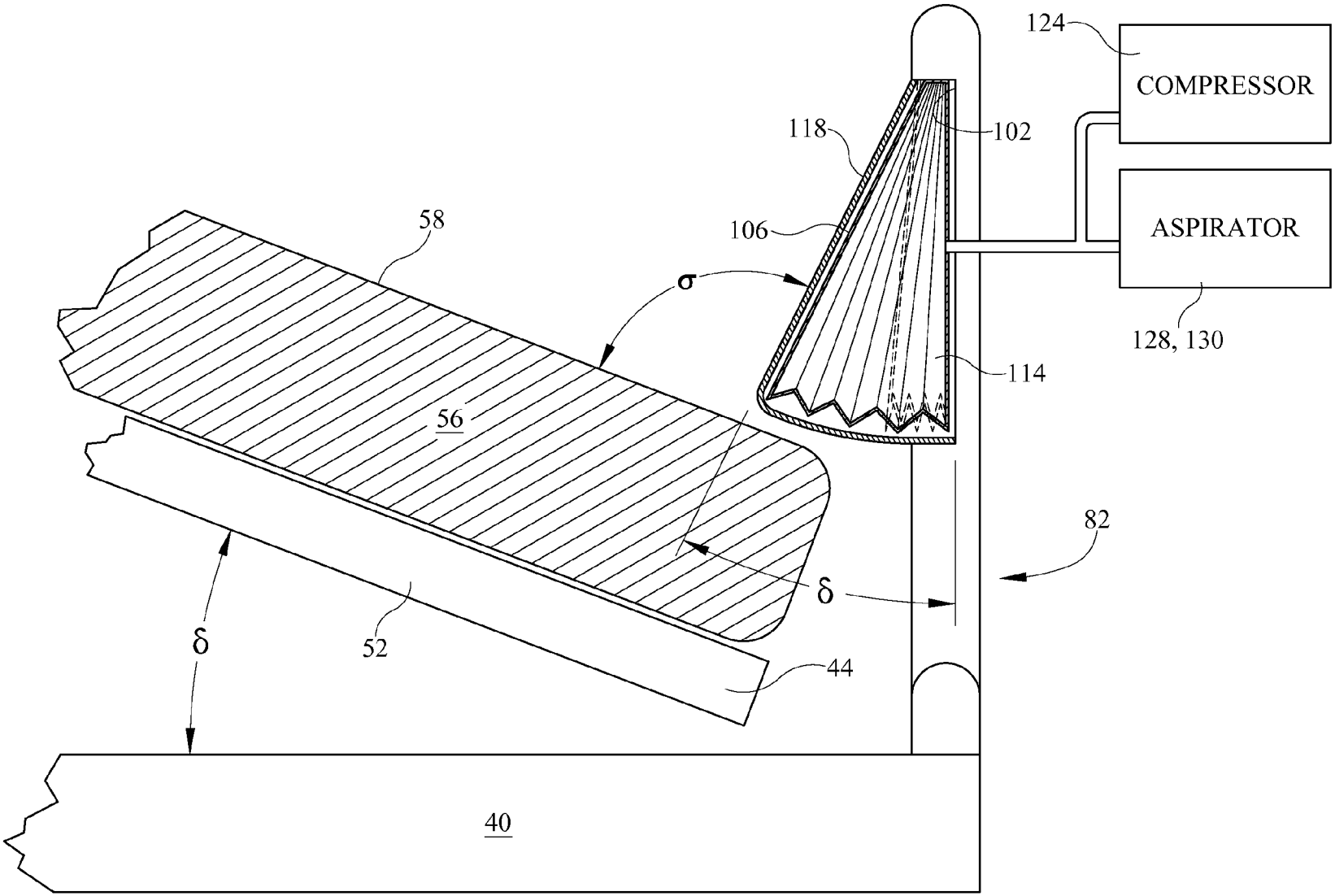
FIG. 10 is a schematic, side elevation view illustrating a cushion in the form of a bellows bladder.
Figure 11:
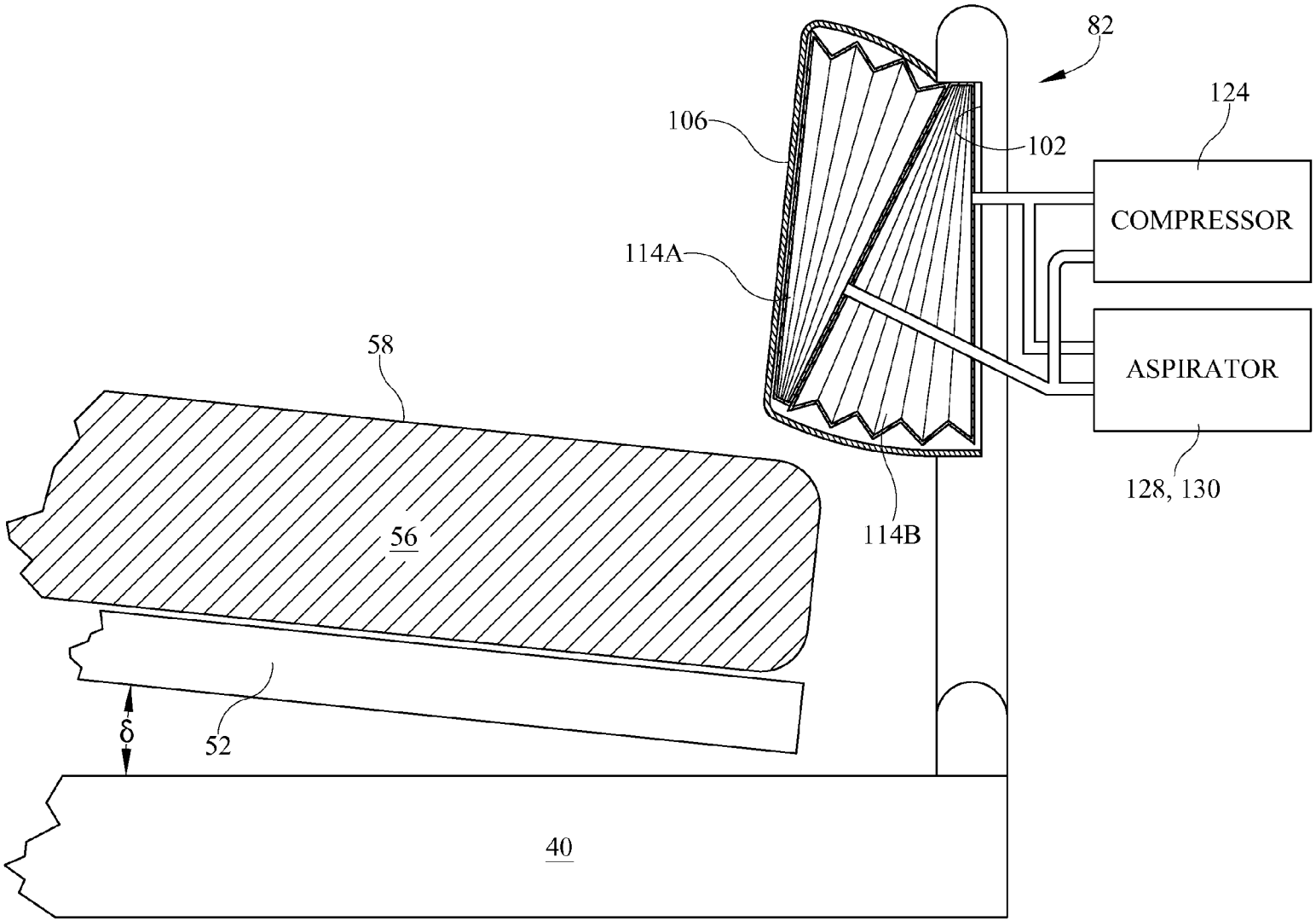
FIG. 11 is a schematic, side elevation view illustrating a cushion in the form of tandem bellows bladders.

In FIGS. 1, 5 and 6 the angle $\sigma$ formed by surface 106 of bladder 114 and top surface 58 of mattress 56 is about ninety degrees. If the footboard is mounted on deck extension 62 (FIGS. 1, 5 and 6) or directly on the deck calf section 52 (FIG. 2) any change in the angular orientation of deck section 52 (e.g. due to a change in angle $\beta$) will cause a corresponding change in the orientation of the footboard, preserving the perpendicularity of surfaces 58, 106. However, if the footboard is frame mounted as in FIG. 3, angle $\sigma$ changes in response to changes in $\beta$. If it is desired to maintain a fixed angular relationship (perpendicular or otherwise) between surfaces 58 and 106, or to achieve a variable angular relationship other than the changing angle $\sigma$ that arises in response to changes in $\beta$, it will be necessary to make provisions for achieving the desired relationship. One way of doing so is a tapered bellows bladder 114 as shown in FIG. 10. The tapered bellows bladder features high extensibility at its lower end and limited extensibility at its upper end. As the orientation of deck 52 relative to frame 40 changes (e.g. to an angle $\delta$) pressurized air is admitted to the bladder to achieve the desired angle $\sigma$ between surfaces 58 and 106. Referring to FIG. 11, two or more tapered bellows bladders 114A, 114B may be used in tandem to improve the ability to achieve a desired angle $\sigma$.

Figure 12:
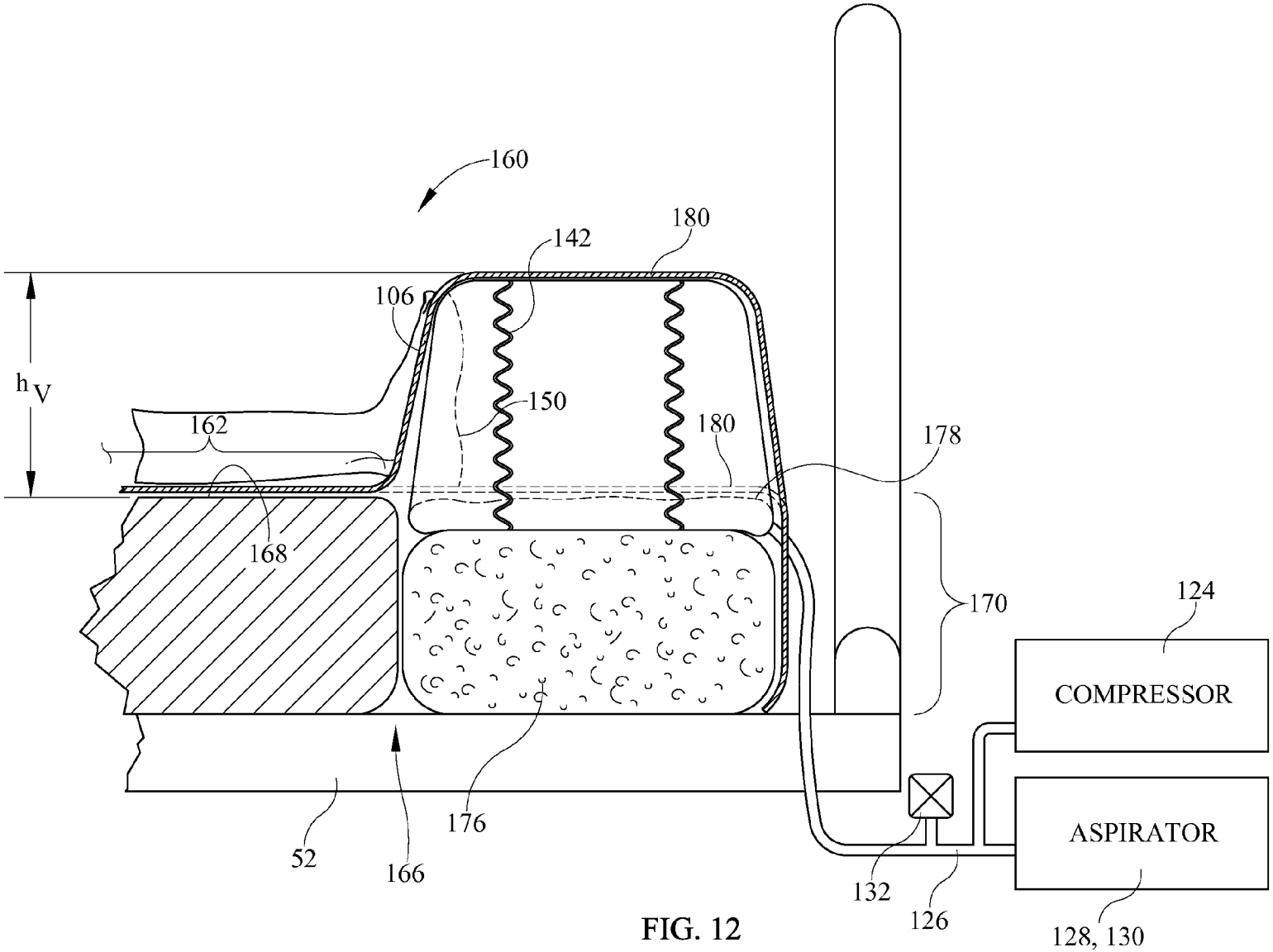
FIG. 12 is a schematic, side elevation view of a mattress system including an occupant support portion with a support surface and a cushion located footwardly of the occupant support portion, the cushion comprising a bladder resting on a foam foundation, and being shown in a deployed state (solid lines) in which the bladder projects vertically higher than the support surface and a stored state (dashed lines) in which it does not project vertically higher than the support surface.

The principles disclosed above can also be employed in a mattress system. FIG. 12 shows a mattress system 160 including a main occupant support portion 162 extending longitudinally from a head end to a foot end 166 and having a top surface 168. The mattress system also includes a cushion 170, located footwardly of the main occupant support portion. At least part of the cushion is pressurizable. In the illustrated embodiment the cushion comprises a nonpressurizable foundation 176 beneath a pressurizable fluid bladder 178. A bed sheet 180 covers the occupant support portion 162 and cushion 170. A dedicated bladder cover, not illustrated but analogous to bladder cover 118 of FIGS. 4-11, can be provided to protect the bladder from contaminants.

A source of pressurized air such as a compressor 124 is connected to the bladder by a fluid transport line 126. The compressor may be a component of the bed or may be independent of the bed. An aspirator 128, such as a pump 130, is also connected to the bladder. The pump may be a separately identifiable component, as shown, or the pump and compressor may be integrated into a single unit. Optionally, an exhaust valve 132 may be used as an aspirator. Although the illustration shows both pump 130 and an exhaust valve 132 it is expected that a commercial embodiment will require only one or the other.

Cushion 170 has a deployed state (solid lines) in which it projects vertically higher than the surface 168. As used herein in the context of the mattress system 160 the vertical direction is the direction perpendicular to surface 168 even if surface 168 is not oriented horizontally, as would occur if deck section 52 were at a nonhorizontal orientation, and independently of any adjustment to the host frame. Cushion 170 also has a stored state (dashed lines) in which it does not project vertically higher than the support surface. The stored state is the result of pressurized air having been vented from the bladder through exhaust valve 132 or having been removed by the pump 130. The deployed state occurs in response to pressurization of the bladder, for example as a result of pressurized air from the air source 124 having been admitted to the interior of the bladder. Although the pressurization and venting of the cushion may be scheduled as a function of an adjustment made to the host frame (e.g. a change in angle $\alpha$ and/or $\beta$) the frame components do not themselves act on cushion 170 to effect a transition between the stored state and the deployed state. It should be appreciated that the intrabladder pressure may need to be elevated to a minimum working pressure before the bladder is effective for its intended purpose.

The mattress system may also include provisions for assisting transition from the deployed state to the stored state. For example if the vent valve 132 is used to relieve intrabladder pressure, a spring 142 can be used to exert a return force on the bladder. The spring can also be used in conjunction with pump 130.

Bladder 178 is constructed so that when it is pressurized to a working pressure, the surface portion 106 facing the occupant presents a foot receptacle 150 shaped and sized to receive an occupant's foot and to maintain interface pressure between the occupant's feet and the surface at levels that are unlikely to promote the development of pressure ulcers or other types of skin breakdown.

In operation, the bed occupant or a caregiver operates the compressor to pressurize the bladder, causing it to increase in volume until it projects vertically higher than surface 168 in the vicinity of the occupant's feet. The bed sheet 180 stretches slightly to accommodate the deployed contour of the bladder. A satisfactory vertical height is a height $h_v$ about equal to at least the length of an occupant's foot. Such lengths can be found in readily available compilations of anthropometric data. The deployed bladder can then be employed to resist any tendency for the bed occupant to migrate toward the foot end of the bed, as typically occurs in response to an increase in the orientation angle $\alpha$ of the deck upper body section 46. Pressurization of the cushion can be a preparatory step carried out prior to changing the orientation angle $\alpha$ or can be carried out concurrently and in coordination with the change in $\alpha$. In the event that occupant migration does occur, the occupant can push against the bladder with his feet to help reposition himself toward the head end of the bed, thereby reversing any tissue shear that resulted from the initial footward migration and placing himself in a more favorable position for correct functioning of bed features that are sensitive to occupant position. The soft character of the cushion, augmented by the foot receptacle 150, if provided, also helps reduce the risk of pressure ulcers if the occupant's feet are in intentional or unintentional contact with the footboard for an extended time.

Figure 13:
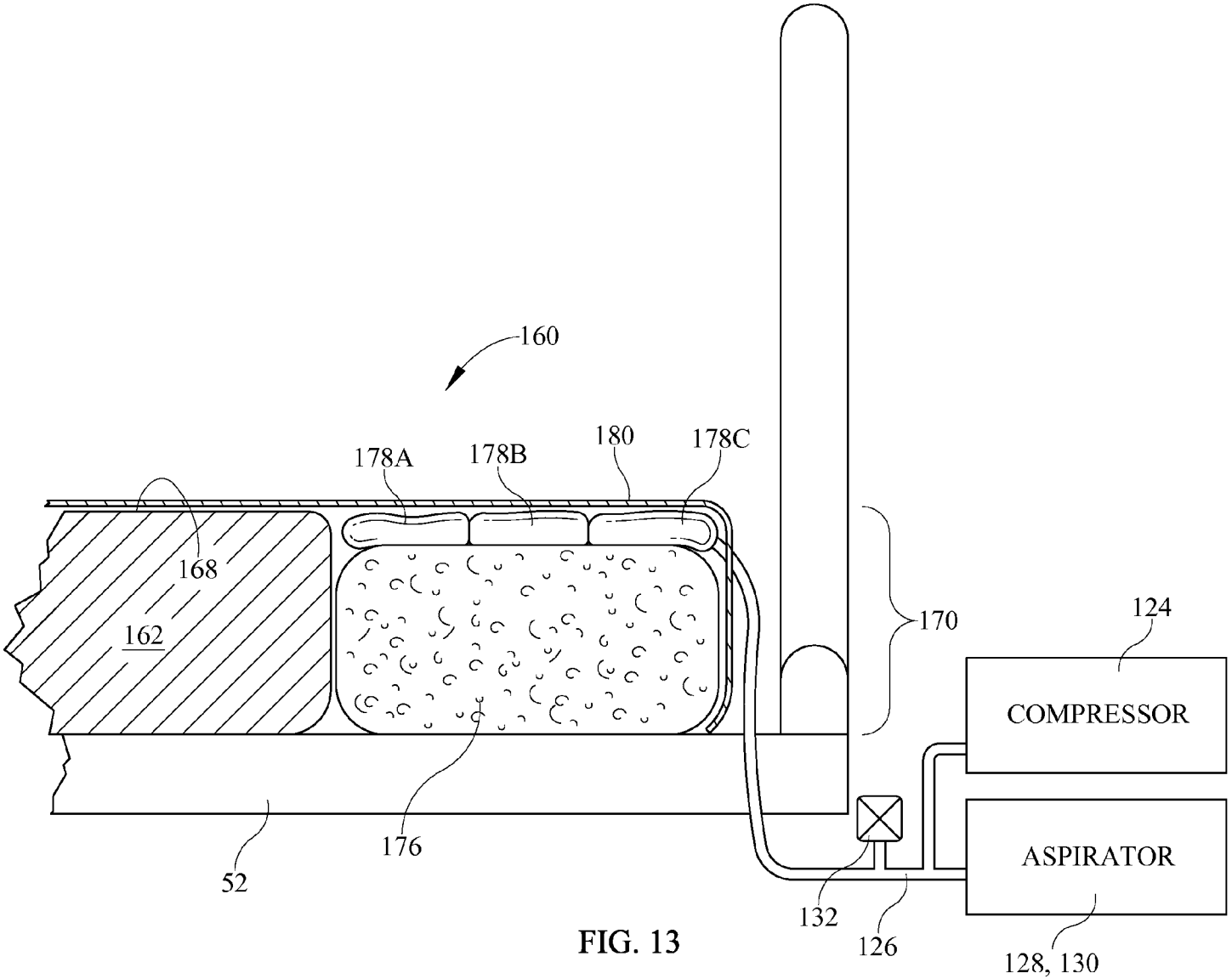
FIGS. 13-18 are views similar to that of FIG. 12 showing various arrangements of single and multiple bladders, standing alone or in combination with a foam foundation or overlay.
Figure 14:
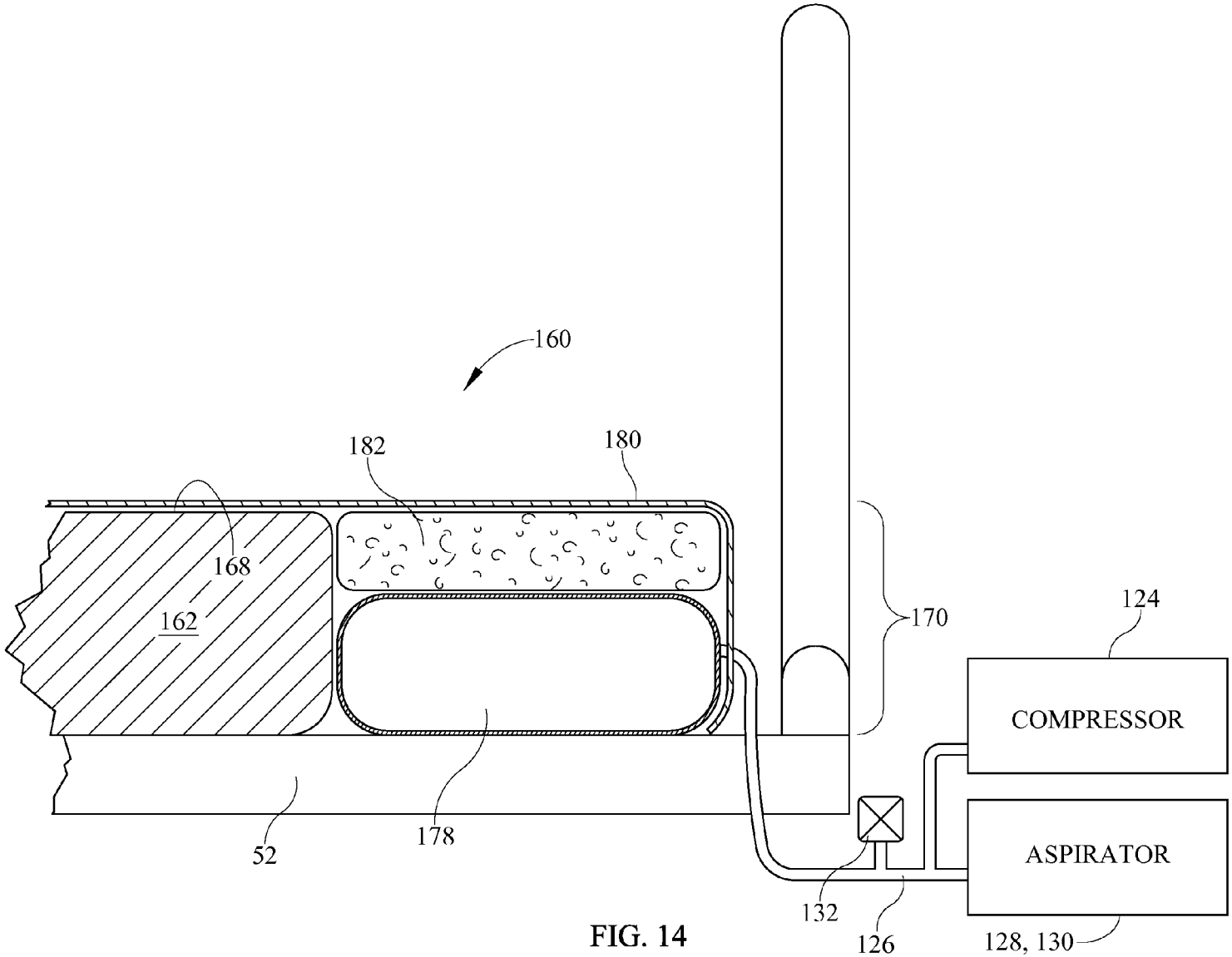
Figure 15:
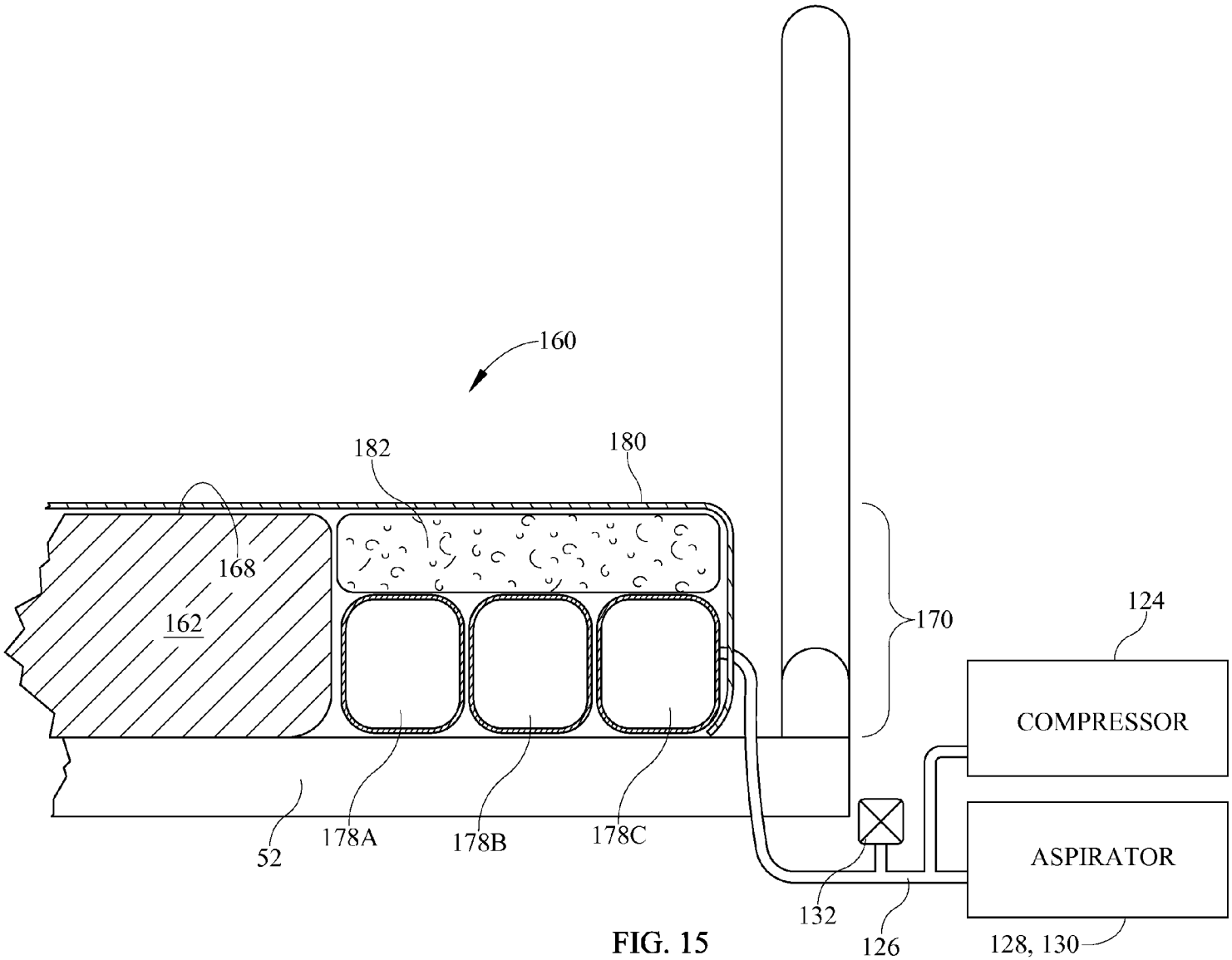
Figure 16:
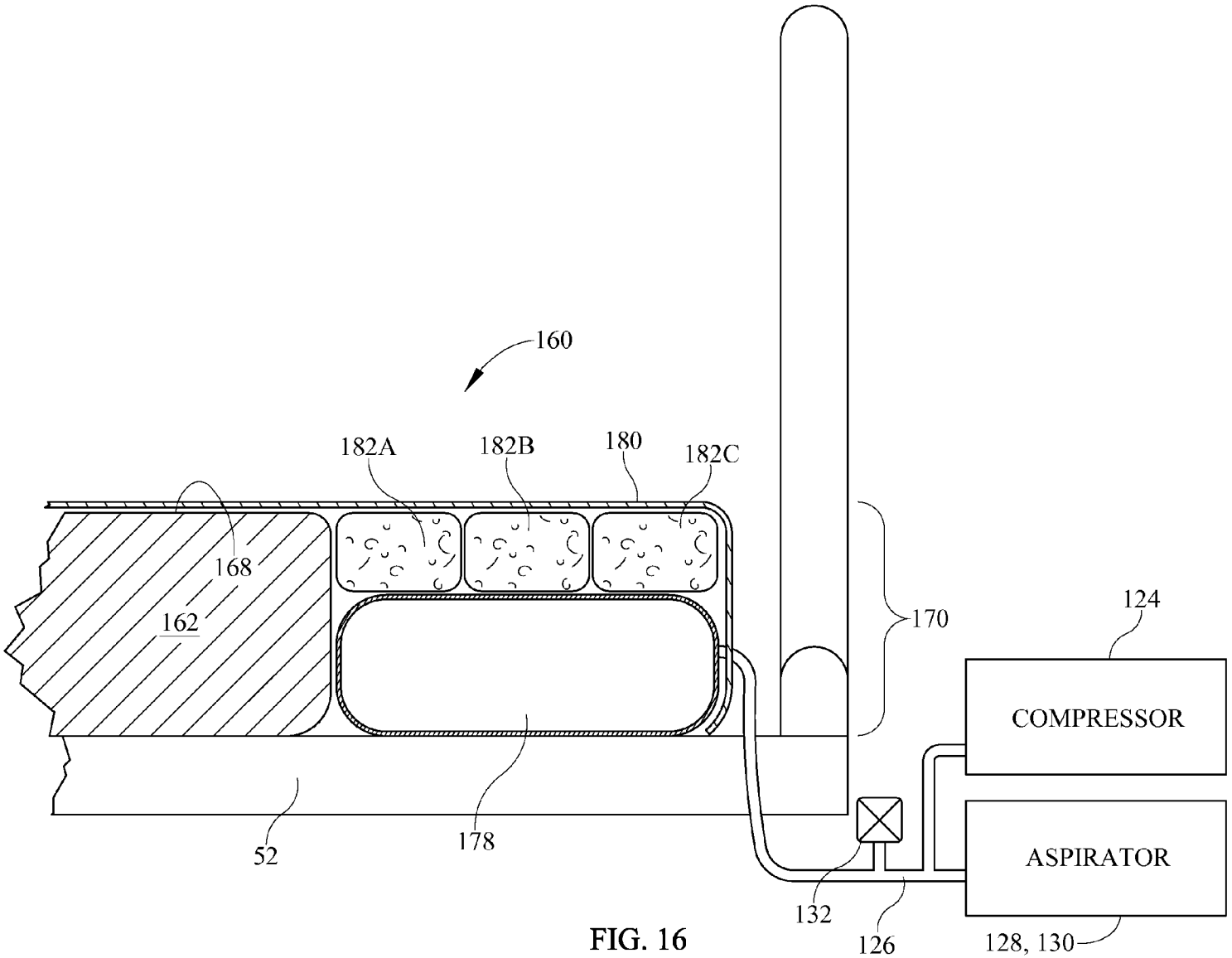
Figure 17:
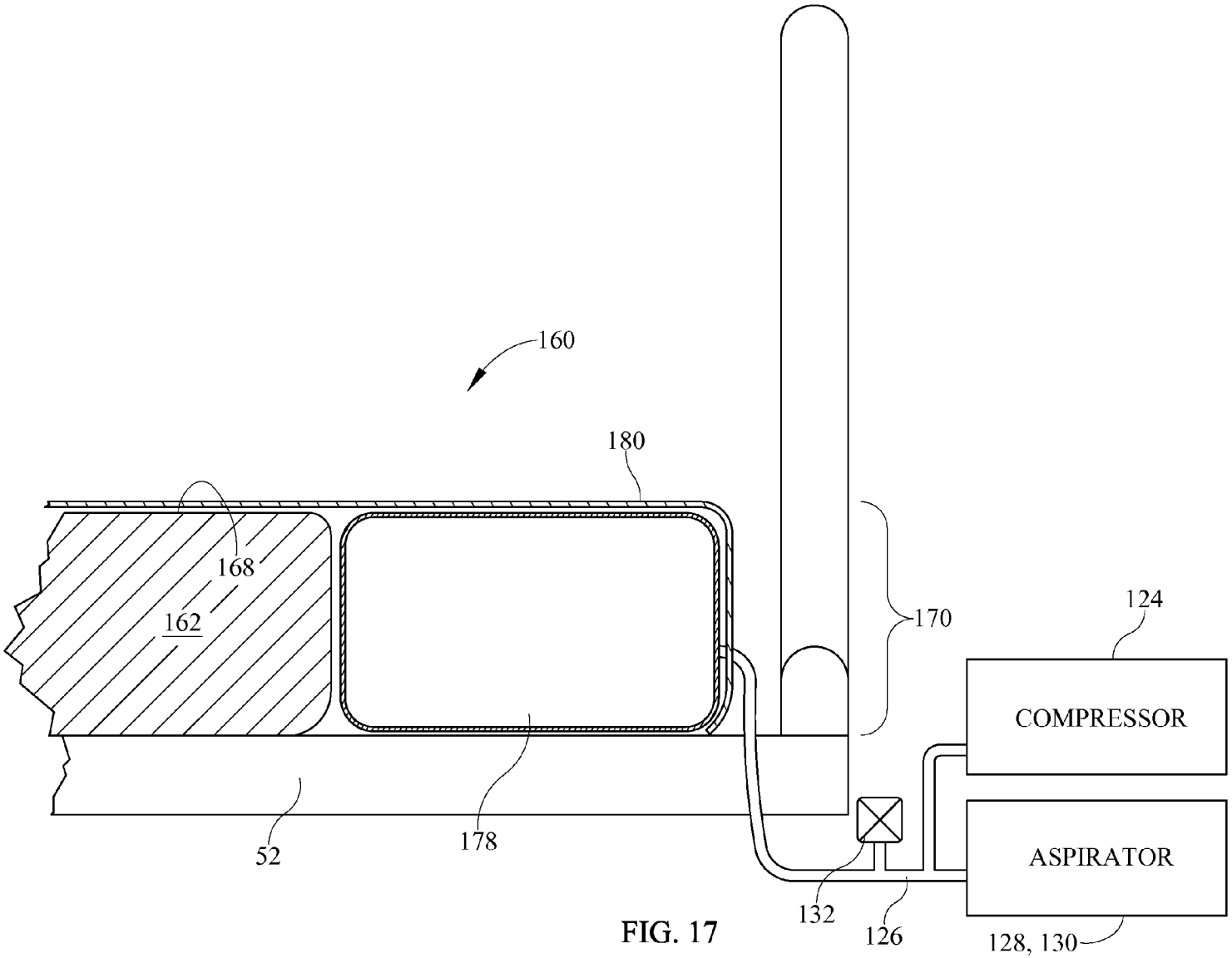
Figure 18:
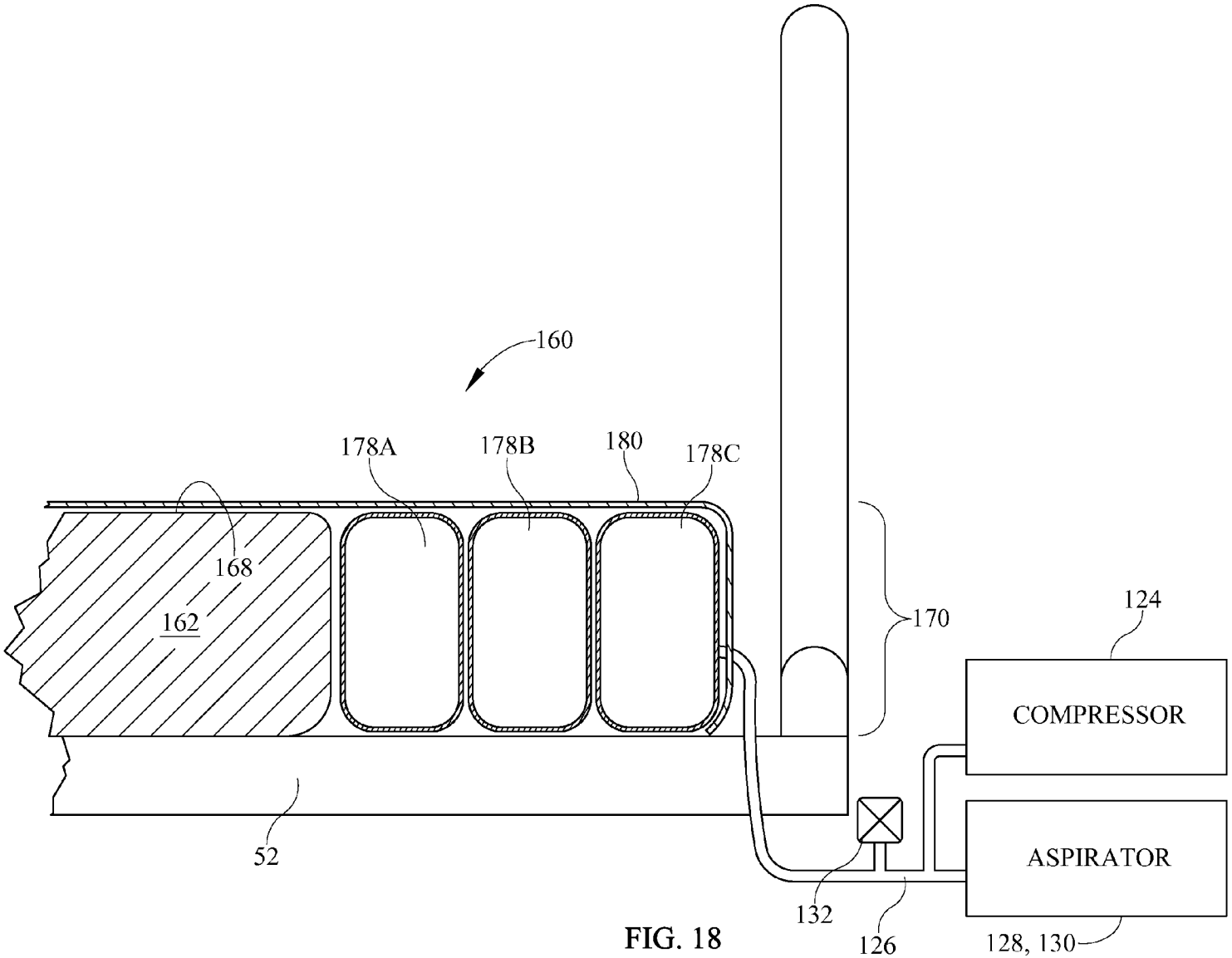

FIGS. 13-18 show other cushion configurations, all in their stored states. FIG. 13 shows a cushion comprising a nonpressurizable foundation 176 supporting multiple pressurizable bladders 178A, 178B, 178C. FIG. 14 shows a pressurizable bladder 178 beneath a nonpressurizable overlay 182. FIG. 15 shows multiple pressurizable bladders 178A, 178B, 178C beneath a nonpressurizable overlay 182. FIG. 16 shows a pressurizable bladder 178 beneath a segmented, nonpressurizable overlay 182 comprising overlay segments 182A, 182B, 182C. FIG. 17 shows a single pressurizable bladder 178 unaccompanied by a nonpressurizable foundation or overlay. FIG. 18 shows multiple pressurizable bladders 178A, 178B, 178C unaccompanied by a nonpressurizable foundation or overlay.

Although this disclosure refers to specific embodiments, it will be understood by those skilled in the art that various changes in form and detail may be made without departing from the subject matter set forth in the accompanying claims.

I claim:

1. A bed frame comprising:

a weight bearing framework having a head end and a foot end;

a footboard cooperating with the framework to define an edge of an occupant region, the footboard having a footboard frame and a pressurizable cushion, wherein the cushion has an extended state in which the cushion extends toward the head end of the framework by an amount $d_1$ relative to a reference datum and a nonextended state in which the cushion extends toward the head end of the framework by an amount $d_2$ relative to the datum, wherein $d_2$ is less than $d_1$; and means for assisting transition from the extended state to the nonextended state, wherein the cushion is a bladder and the means for assisting transition from the extended state to the nonextended state includes a plurality of springs.

2. The bed frame of claim 1 wherein the pressurizable cushion is a fluid bladder.

3. The bed frame of claim 1 wherein the cushion becomes increasingly firm in response to increasing intrabladder pressure and becomes increasingly soft in response to decreasing intrabladder pressure without a commensurate change in volume attributable to the changes in intrabladder pressure.

4. The bed frame of claim 1 wherein the frame is longitudinally length adjustable.

5. The bed frame of claim 1 wherein, in the extended state, a lower extremity of the bladder is substantially at a mattress elevation.

6. The bed frame of claim 1 wherein the cushion is pressurizable to a working pressure and, when pressurized to the working pressure, presents a foot receptacle shaped and sized to receive an occupant's foot.

7. A bed frame comprising:

a framework having a head end and a foot end;

a footboard coupled to the framework adjacent the foot end, the footboard having a footboard frame and a pressurizable cushion, wherein the cushion has an extended state in which the cushion extends toward the head end of the framework by a first distance relative the footboard frame and a nonextended state in which the cushion extends toward the head end of the framework by a second distance that is less than the first distance; and a mover to assist transition from the extended state to the nonextended state, wherein the cushion comprises a bladder and the mover comprises a resilient member that exerts a return force on the bladder and an aspirator for relieving pressure in the bladder.

8. The bed frame of claim 7, wherein the aspirator comprises a pump that is operable to remove fluid from the cushion.

9. The bed frame of claim 7, wherein the aspirator comprises an exhaust valve through which fluid vents from the cushion.

10. The bed frame of claim 7, wherein the resilient member comprises a spring.

11. The bed frame of claim 7, wherein the resilient member comprises a plurality of springs.

12. The bed frame of claim 7, wherein the bladder comprises pleats.

13. The bed frame of claim 7, wherein the footboard frame includes a recess in which substantially all of the bladder is situated when in the nonextended state.

14. The bed frame of claim 7, further comprising a cover surrounding an exterior surface of the bladder.

15. The bed frame of claim 14, wherein the cover comprises an elastic cover.

16. The bed frame of claim 14, wherein the cover is coupled to the footboard frame and is detachable from the footboard frame.

17. The bed frame of claim 7, wherein the bladder has a foot receptacle shaped and sized to receive an occupant's foot when the bladder is in the extended state.

18. The bed frame of claim 7, further comprising a source of pressurized air to pressurize the bladder.

19. The bed frame of claim 18, wherein the aspirator and the source of pressurized air are integrated.

* * * * *